US005666914A

United States Patent [19]

Ushida et al.

[11] Patent Number: 5,666,914

[45] Date of Patent: Sep. 16, 1997

[54] VANE TYPE ANGULAR PHASE ADJUSTING DEVICE

[75] Inventors: Masayasu Ushida, Okazaki; Michio Adachi, Obu, both of Japan

[73] Assignee: Nippondenso Co., Ltd., Kariya, Japan

[21] Appl. No.: 582,984

[22] PCT Filed: May 12, 1995

[86] PCT No.: PCT/JP95/00916

§ 371 Date: Jan. 11, 1996

§ 102(e) Date: Jan. 11, 1996

[87] PCT Pub. No.: WO95/31633

PCT Pub. Date: Nov. 23, 1995

[30] Foreign Application Priority Data

May 13, 1994 [JP] Japan ..... 6-100114
Aug. 29, 1994 [JP] Japan ..... 6-203251

[51] Int. Cl.[6] ..... F01L 1/344

[52] U.S. Cl. ..... 123/90.17; 123/90.31; 74/568 R; 464/2

[58] Field of Search ..... 123/90.12, 90.15, 123/90.16, 90.17, 90.31; 74/568 R; 464/1, 2, 160

[56] References Cited

U.S. PATENT DOCUMENTS

| | | | |
|---|---|---|---|
| 4,858,572 | 8/1989 | Shirai et al. | 123/90.15 |
| 5,056,477 | 10/1991 | Linder et al. | 123/90.17 |
| 5,107,804 | 4/1992 | Becker et al. | 123/90.17 |
| 5,172,659 | 12/1992 | Butterfield et al. | 123/90.17 |
| 5,184,578 | 2/1993 | Quinn, Jr. et al. | 123/90.17 |
| 5,218,935 | 6/1993 | Quinn, Jr. et al. | 123/90.17 |
| 5,289,805 | 3/1994 | Quinn, Jr. et al. | 123/90.17 |
| 5,361,735 | 11/1994 | Butterfield et al. | 123/90.17 |
| 5,450,825 | 9/1995 | Geyer et al. | 123/90.17 |

FOREIGN PATENT DOCUMENTS

| | | |
|---|---|---|
| 62-008631 | 7/1987 | Japan . |
| 2-050105 | 4/1990 | Japan . |
| 90/08248 | 7/1990 | WIPO . |

*Primary Examiner*—Weilun Lo
*Attorney, Agent, or Firm*—Cushman, Darby & Cushman IP Group of Pillsbury Madison & Sutro LLP

[57] ABSTRACT

Angular phase of a cam shaft of an internal combustion engine is adjusted by changing angular position of a vane rotor in a shoe housing. Each of vanes 2 has a couple of a check valve and a pilot valve which are moving members moving in parallel with the rotation axis to switch on and off oil passages. Since the moving members move in parallel with the rotation axis, the motion thereof is not affected by the centrifugal force caused by the rotation. Further, since the moving members are accommodated inside the vanes, sealing between advancing chambers and retarding chambers which are disposed opposite sides of the vanes can be ensured without increasing the size, particularly the outer diameter, of the device.

19 Claims, 12 Drawing Sheets

VANE TYPE ANGULAR PHASE ADJUSTING DEVICE

This application claims benefit of international application PCT/JP95/00916, filed May 12, 1995.

TECHNICAL FIELD

The present invention relates to an adjusting device of an angular phase between an input shaft and an output shaft, which can be used for a valve-timing-adjusting device for an internal combustion engine (hereinafter referred to as engine) which changes the angular phase between the crank shaft and the cam shaft, thereby changing operation timing of the air intake valve and the exhaust valve in accordance with engine conditions.

BACKGROUND ART

A vane-type valve-timing-adjusting-device, which drives the cam shaft via a timing pulley or a chain sprocket which rotates in synchronism with the engine crank shaft to control operation of the air intake valve and the exhaust valve in accordance with the phase difference between the timing pulley or the chain sprocket and the cam shaft, is well known. Such vane-type valve-timing-adjusting devices are disclosed in Japanese Patent Unexamined publication Hei 1-92504, Japanese Utility Model Unexamined Publication Hei 2-50105, Japanese Patent Unexamined Publication Hei 5-106412, and Japanese Patent Unexamined Publication Hei 5-214907. Such kind of vane-type valve-timing-adjusting devices has a pressure chamber disposed at an inner periphery of the timing pulley and a vane disposed in the pressure chamber. The vane is rotated relative to the cam shaft by oil pressure, for instance, in the advancing or retarding direction to control the valve timing of the intake valve and the exhaust valve.

However, since the circumferential width of the vane of the above conventional vane-type valve-timing-adjusting device is so small, it is difficult to seal gaps between an advancing chamber and a retarding chamber by the circumferential edge of the vane. For instance, when the vane is rotated by the pressure difference between the retarding chamber and the advancing chamber, oil may leak between the two chambers with the result that the pressure difference between the retarding chamber and the advancing chamber may not become a predetermined value and that accurate control of the intake and exhaust valves may not be carried out.

Japanese Patent Unexamined Publications Hei 5-106412 and Hei 5-214907 disclose devices in which each vane has lobes on the outer periphery thereof and accommodates two check valves inside thereof. However, the check valve must endure the centrifugal force caused by rotation of the cam shaft. In addition, since the vane of the above conventional device accommodates the check valves at the central portion thereof, the size of the lobe is limited and, therefore, cannot have sufficient area to receive the oil pressure, resulting in increasing the size of the device.

DISCLOSURE OF THE INVENTION

A main object of the present invention is to solve the above-mentioned problems of the conventional devices.

Another object of present invention is to provide a vane-type angular-phase-adjusting device which includes a vane disposed between the advancing chamber and the retarding chamber having width sufficient to prevent oil from leaking between those two pressure oil chambers.

Another object of the present invention is to provide a vane-type angular-phase-adjusting device which has a structure for reducing the centrifugal force exerted on a member moving in response to the oil pressure.

A further object of the present invention is to provide a vane-type angular-phase-adjusting device which has a small diameter.

In order to carry out the above object, a vane-type angular-phase-adjusting device includes a shoe housing having a circular space, and a fan-shaped space disposed radially outside the circular space formed inside the shoe housing and connected to one of the input and output shafts; a vane rotor having a vane at an outer periphery and a rotating shaft, the vane projecting radially from the outer periphery and is disposed rotatably in the fan-shaped space to partition the space into an advancing chamber and a retarding chamber; and a moving member, disposed inside the vane of the vane rotor, moving in response to oil pressure.

Since the moving member is accommodated inside the vanes of the vane rotor, the device can provide wide vanes without increase of the size of the device, thereby enhancing sealing of the advancing chambers and the retarding chambers.

The moving member is preferably composed of a member moving in a direction approximately in parallel with rotating shafts of the shoe housing and the vane rotor, so that the influence of the centrifugal force can be reduced.

Further, it is preferable that a plate member (4, 5) is fixed to the shoe housing to close open ends of the advancing chambers and the retarding chambers, and the moving member is disposed inside the vane to face the plate member.

Further, the vane rotor can have a oil passage connecting one of the advancing chambers and the retarding chambers, and the moving member moves in response to oil pressure of the oil passage.

The vane rotor may include a bolt, disposed at a central portion of the vane rotor, to fasten the vane rotor to one of the input shaft or the output shaft, so that the vane rotor and the shaft can be connected without increasing the size of the device.

The moving member may include a check valve (20, 39) or a pilot valve (25, 35).

Further, it is preferable to have at least one of the following three conditions:

the vane rotor includes vanes totalling to n-vanes each having an arc-angle C and a rotation angle A, with a first condition that $C \geqq (360°/n)-2A$; each of the vanes has a cross-sectional minimum sealing length $L_1$ between the advancing chamber and the retarding chamber and each of the shoe housing has a cross-sectional minimum sealing length $L_2$ between the advancing chamber and the retarding chamber, with a second condition that $L_1$ is equal to or longer than $L_2$; each of the vanes has cross section sealing a portion between the advancing chamber and the retarding chamber, and the shoe housing has cross section sealing a portion between the advancing chamber and the retarding chamber, with a third condition that the former cross section is equal to or greater than the latter cross section.

In order to attain the above object, the present invention is to provide a vane-type angular-phase-adjusting device which includes a shoe housing (3) having a circular space, and a fan-shaped space disposed radially outside the circular space formed inside the shoe housing and connected to one of the input and output shafts; a vane rotor (9) having a vane (9*a*, 9*b*) at an outer periphery, the vane projecting radially outside the outer periphery and is disposed rotatably in the fan-shaped space to partition the space into an advancing chamber and a retarding chamber; and a moving member (20, 25, 30, 35), disposed inside the vane of the vane rotor, moving in parallel with an axis of the vane rotor.

Thus, the centrifugal force exerted on the moving member can be reduced to ensure accurate motion in response to oil pressure.

The device may include a plate member fixed to the shoe housing to close open ends of the advancing chamber and the retarding chamber, and the moving member (4, 5) is preferably disposed inside the vane to face the plate member.

It is preferable that the vane rotor has a oil passage connecting one of the advancing chamber and the retarding chamber, and that the moving member moves in response to oil pressure of the oil passage. Thus, the pressure oil for driving the moving member can be introduced with a simple structure.

It is preferable that the vane rotor includes a bolt disposed at a central portion of the vane rotor to fasten the vane rotor to one of the input shaft or the output shaft.

It is preferable that the moving member includes a check valve (20, 39) or a pilot valve (25, 35).

In addition to the above structure it is preferable to have at least one of the following three conditions:

the vane rotor further includes vanes totalling to n-vanes each having an arc-angle C and a rotation angle A, with a first condition that $C \geqq (360°/n)-2A$; each of the vanes has a cross-sectional minimum sealing length $L_1$ between the advancing chamber and the retarding chamber and each of the shoe housing has a cross-sectional minimum sealing length $L_2$ between the advancing chamber and the retarding chamber, with a second condition that $L_1$ is equal to or longer than $L_2$; each of the vanes has cross section sealing a portion between the advancing chamber and the retarding chamber, and the shoe housing has cross section sealing a portion between the advancing chamber and the retarding chamber, with a third condition that the former cross section is equal to or greater than the latter cross section.

Thus, sealing of the portion between the advancing chamber and the retarding chamber disposed opposite sides of the vane can be enhanced.

In order to carry out the above invention the present invention is to provide a valve timing control device disposed between a crank shaft and a cam shaft for controlling angular phase between the shafts which includes: a vane rotor (9) connected to the cam shaft and having at least two vanes (9*a*, 9*b*); a shoe housing (3) rotating in synchronism with the crank shaft and rotatably accommodating the vane rotor, the shoe housing having a shoe (3*a*, 3*b*) projecting to partition a space inside the vane into a advancing chamber and a retarding chamber; and a moving member, disposed inside the vane of the vane rotor, moving in parallel with an axis of the vane rotor and the vane rotor in response to oil pressure.

The vane rotor may have an oil passage connected to the advancing chamber and an oil passage connected to the retarding chamber. The oil passages open to an axial end of the vane rotor.

Thus, pressure oil can be supplied to the advancing chamber and the retarding chamber by simple oil passages.

The moving member may be arranged to move in response to oil pressure of at least one of the advancing chamber and the retarding chamber.

The device may include a plate member fixed to the shoe housing to close open ends of the advancing chamber and the retarding chamber, and the moving member can be disposed inside the vane to face the plate member.

It is preferable that the vane rotor includes a bolt disposed at a central portion of the vane rotor to fasten the vane to another member, and the shoe has a bolt to fasten the shoe housing to another member. Thus the bolts can be disposed effectively in the device as fastening members without increase of the size thereof.

BEST MODE OF CARRYING OUT THE INVENTION

Embodiments of the present invention are described with reference to the appended drawings.

(First Embodiment)

A valve timing control device according to a first embodiment is described with reference to FIG. 1 through FIG. 7.

A timing pulley 1 is driven by a timing belt (not shown) and rotates in synchronism with a crank shaft (not shown) of an engine. A cam shaft 2 is driven by the timing pulley 1, which is a transmitting member, and rotates at a certain phase difference from the timing pulley 2. The timing pulley 1 and the cam shaft 2 rotate clockwise viewing from a portion indicated by an arrow A of FIG. 2. This direction of rotation represents advance direction hereafter.

Figure 3:
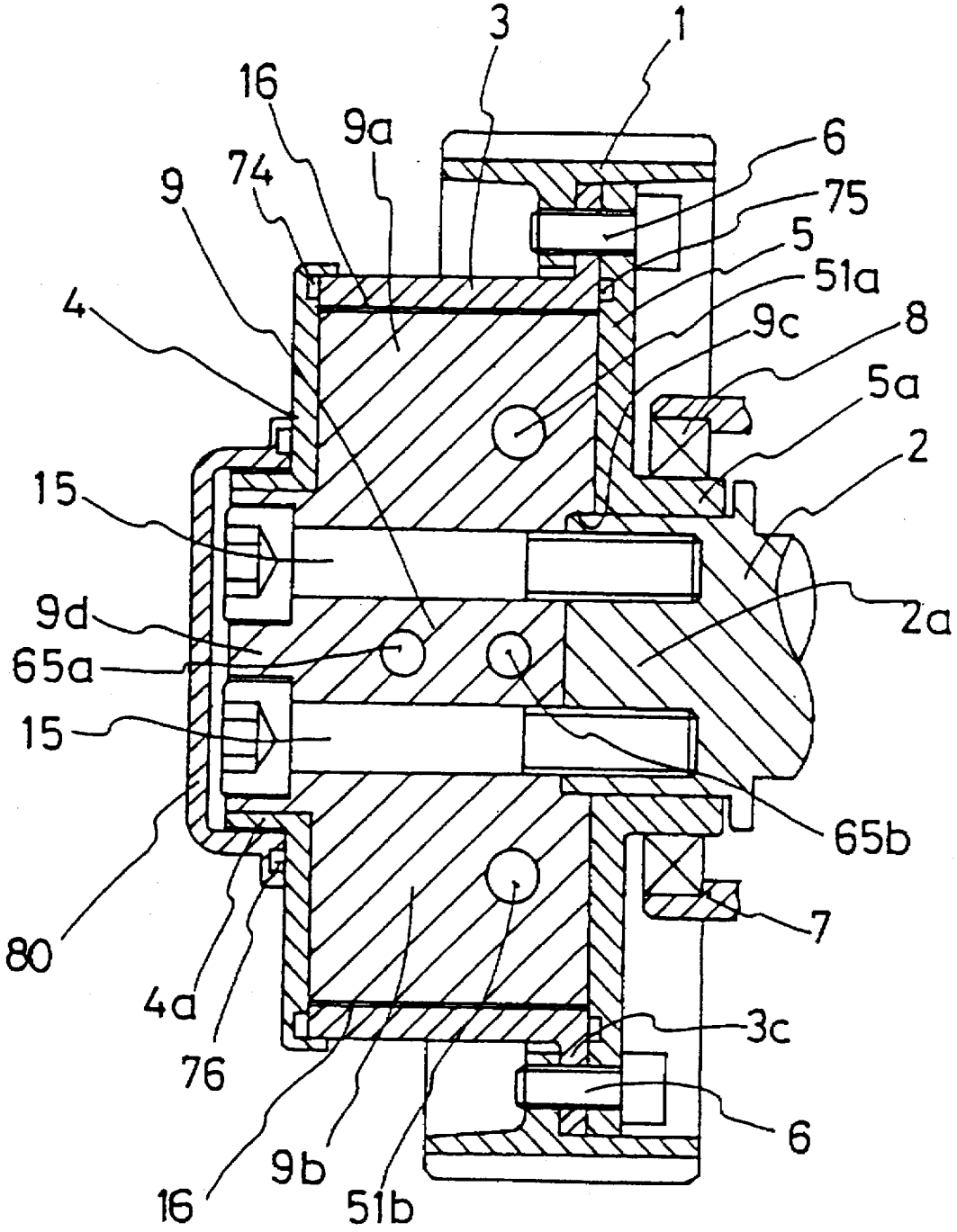
FIG. 3 is a cross sectional view cut along a line III—III of FIG. 1.

The timing pulley 1, a shoe housing 3 and a front plate 4 are fastened coaxially by bolts 14. The timing pulley 1, the shoe housing 3 and a rear plate 5 are fastened coaxially by four bolts 6. An inner periphery of a boss portion 5*a* of the rear plate 5 receives rotatably a head portion 2*a* of the cam shaft 2 and an outer periphery of the boss portion 5*a* is in contact with an oil seal 8 of a cylinder head 7 as shown in FIG. 3.

Figure 1:
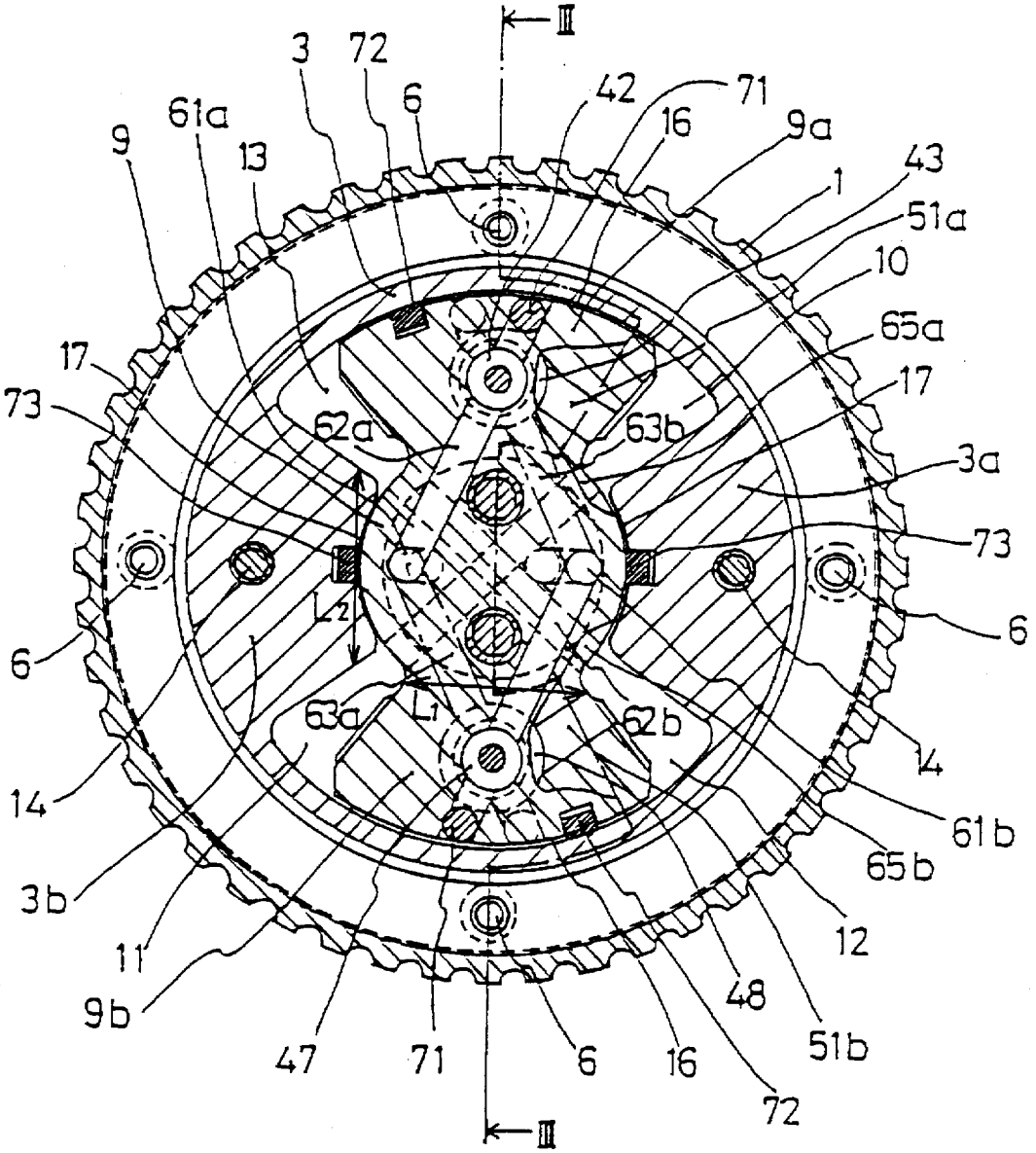
FIG. 1 is a cross-sectional view cut along a line I—I of FIG. 2 to illustrate a valve timing control device for an engine according to a first embodiment.

The shoe housing 3 is a housing to accommodate the vane 3 rotatably therein, and has a pair of trapezoidal shoes 3*a* and 3*b* disposed opposite to each other as shown in FIG. 1. The shoes 3*a* and 3*b* are disposed respectively between vanes 9*a* and 9*b* of a vane rotor 9. Each of the inner surfaces of the shoes 3*a* and 3*b* are formed into an arc, and arc-shaped spaces are formed between the shoes 3*a* and 3*b* to accommodate the vanes 9*a* and 9*b*. A flange portion 3*c* of the shoe housing 3 is disposed between the timing plate 1 and the rear plate 5 and is fastened by the bolts 6 as shown in FIG. 3.

The vane rotor 9 has a circular central portion and a pair of the arc-shaped vanes 9*a* and 9*b* radially opposite sides of the central portion. The vanes 9*a* and 9*b* are accommodated rotatably in the arc-shaped spaces formed between the shoes 3*a* and 3*b*. A concave portion 9*c* of the vane rotor 9 has the head portion 2*a* of the cam shaft 2 fitted coaxially therein, and the vane rotor 9 is fastened to the cam shaft 2 by two bolts 15. A cylindrical head 9*d* of the vane rotor 9 is fitted rotatably into an inner periphery of a boss portion 4*a* of the front plate 4. Small gaps 16 and 17 are formed between the outer periphery of the vane rotor 9 and the inner periphery of the shoe housing 3 so that the vane rotor 9 can rotate relative to the shoe housing 3 as shown in FIG. 1. The gaps 16 and 17 are sealed by sealing members 72 respectively. A retarding chamber 10 is formed between the shoe 3*a* and the vane 9*a*; a retarding chamber 11 is formed between the shoe 3*b* and the vane 9*b*; a advancing chamber 12 is formed between the shoe 3*a* and the vane 9*b*; and an advancing chamber 13 is formed between the shoe 3*b* and the vane 9*a*.

Thus, the timing pulley 1, the shoe housing 3, the front housing 4 and the rear housing 5 rotates together, and the cam shaft 2 and the vane rotor 9 rotate coaxially relative to the timing pulley 1, the shoe housing 3, the front plate 4 and the rear plate 5. Since the shoe housing 3, the front plate 4 and the rear plate 5 rotate in a unit, both end-surfaces of the shoe housing 3 and the respective surfaces of the front plate 4 and the rear plate 5 (which face the shoe housing 3 in the axial direction) can be hermetically sealed. Gaps are formed between inner surfaces of the front plate 4 and the rear plate 5 (which face the vane rotor 9 in the axial direction) and end surfaces of the vanes 9*a* and 9*b* so that the vanes 9*a* and 9*b* can rotate relative to shoe housing 3.

For this purpose, axial length of the vanes 9*a* and 9*b* between the front plate 4 and the rear plate 5 is designed slightly smaller than axial length of the shoe housing 3. In order to minimize leaking of oil between the retarding chamber 10 and advancing chamber 13, and between the retarding chamber 11 and advancing chamber 12 through small gaps between the vane rotor 9 and the front plate 4 and between the former and the rear plate 5, the shortest distance $L_1$ between end surfaces of the vanes 9*a* and 9*b* which seal portions between the retarding chamber 10 and the advancing chamber 13 and between the retarding chamber 11 and the advancing chamber 12 is formed to be equal to the shortest distance $L_2$ between end surfaces of the shoes 3*a* and 3*b* which seal portions between the retarding chamber 10 and the advancing chamber 12 and between the retarding chamber 11 and the advancing chamber 13, as shown in FIG. 1. The cross sections of the fan-shaped portion of the vanes 9*a* and 9*b* are approximately equal to the trapezoidal cross sections of the shoes 3*a* and 3*b*. Thus, the oil leakage over the entire portions of the vanes 9*a* and 9*b* between the retarding chamber 10 and the advancing chamber 13 and between the retarding chamber 11 and the advancing chamber 12 can be reduced.

Figure 2:
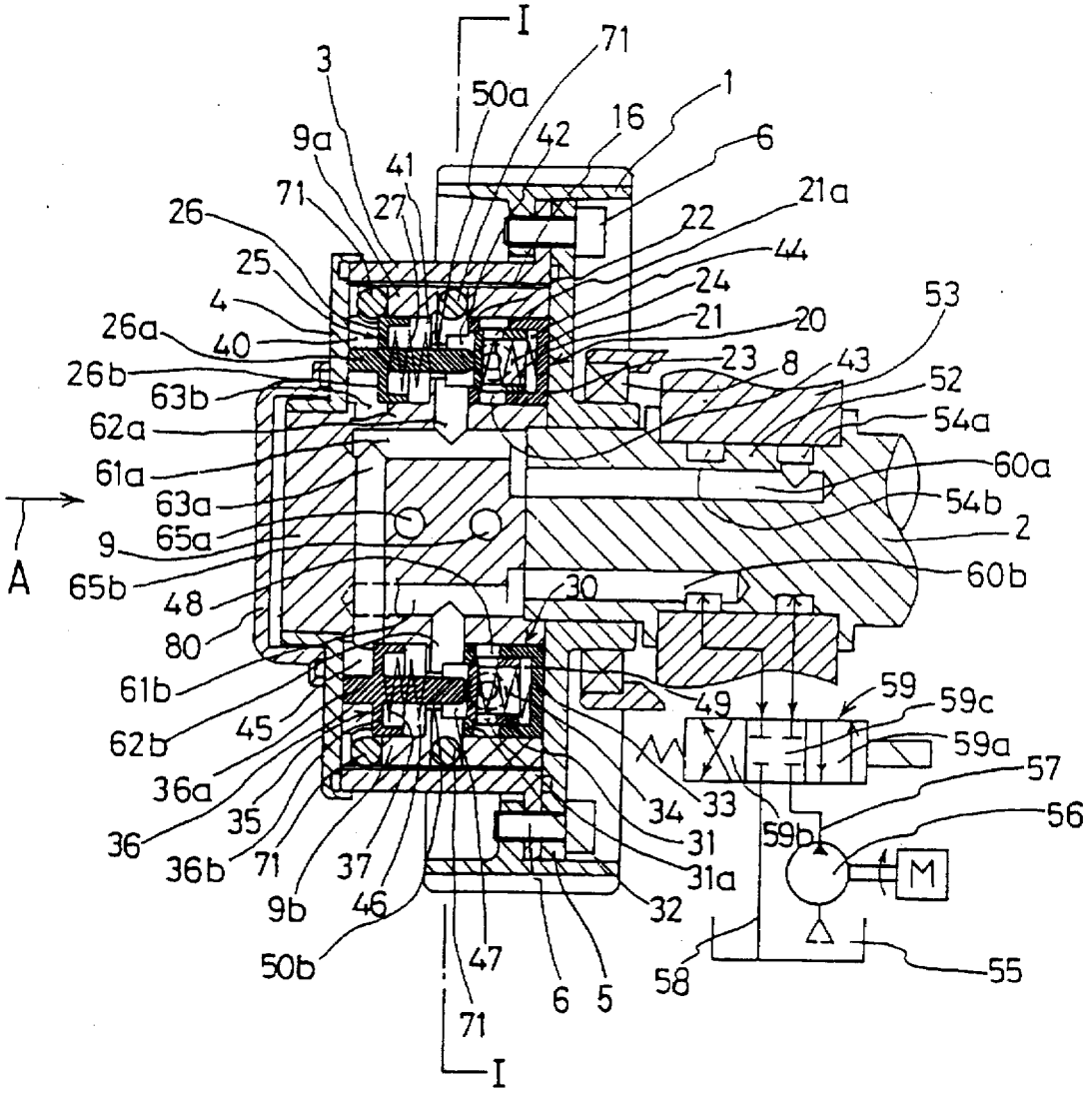
FIG. 2 is a cross-sectional view illustrating the valve timing control device for an engine according to the first embodiment.

Check valves 20 and 30 are disposed inside the vanes 9*a* and 9*b* as shown in FIG. 2. The check valve 20 is composed of a valve body 21, a seal ring 22, a guide member 23 and a compression coil spring 24, and the check valve 30 is composed of a valve body 31, a seal ring 31, a guide member 33 and a compression coil spring 34. The valve bodies 21 and 31 are formed into cylindrical members having bottoms and oil holes 21*a* and 31*a* respectively. The valve bodies 21 and 31 are biased by the compression coil springs 24 and 34 so that the bottoms are seated on valve seats formed respectively on the seal rings 24 and 34 to close as shown in FIG. 2. The guide members 23 and 33 are formed into cylindrical members which have bottoms, and have openings open in a direction opposite openings of the valve bodies 21 and 31. The valve bodies 21 and 31 are received by the inner surfaces of the guide members 23 and 33 to slide in the axial direction of the cam shaft 2.

Pilot valves 25 and 35 are disposed to face the check valves 20 and 30. The pilot valve 25 is composed of a valve body 26 and a compression spring 27, and the pilot valve 35 is composed of a valve body 36 and a compression coil spring 27. The valve bodies 26 and 36 are disposed in the vanes 9*a* and 9*b* so as to move back and forth in the axial direction of the cam shaft 2. The valve bodies 26 and 36 are biased against the inner surface of the front plate 4 by the compression coil spring 27 and 37 respectively. The valve body 26 is molded to have a rod 26*a* and a sliding member 26*b* in a unit, and the valve body 36 is molded to have a rod 36*a* and a sliding member 36*b* in a unit. The rods 26*a* and 36*a* extend through oil passages 50*a* and 50*b* to portions near the valve bodies 21 and 31. The sliding members 26*b* and 36*b* are composed of disk portions for retaining the coil springs 27 and 37 and annular sliding members extending axially from the periphery of the disk portions. The check valve 20 and the pilot valve 25 form a pilot type check valve 100*a* which is a moving member, and the check valve 30 and the pilot valve 35 form a pilot type check valve 100*b* which is a moving member.

The valve bodies 21, 26, 31, 36 may be considered spools which move in response to oil pressure applied thereto and correspond to moving member movable in response to oil pressure.

Pressure oil chambers 40 and 41 are formed respectively on both ends of the valve body 26, and pressure oil chambers 45 and 46 are formed respectively on both ends of the valve body 36. Pressure oil chambers 42, 43 and 44 are formed on both ends of the valve body 21, and pressure oil chambers 47, 48 and 49 are formed on both ends of the valve body 31. The pressure oil chambers 41 and 42 are connected by an oil passage 50*a*; the pressure oil chambers 46 and 47 are connected by an oil passage 50*b*; the pressure oil chambers 43 and 44 are connected through the oil hole 21*a* formed in the valve body 21; and the pressure oil chambers 48 and 49 are connected through the oil hole 31*a* formed in the valve body 31. Connection of the pressure oil chambers 42 and 44 is interrupted when the valve body 21 is seated on the seal ring 22, and is established when the valve body 21 leaves the seal ring 22. Connection of the pressure oil chambers 47 and 49 is interrupted when the valve body 31 is seated on the seal ring 32, and is established when the valve body 31 leaves the seal ring 32. The pressure oil chamber 43 is connected to the retarding chamber 10 through the oil passage 51*a*, and the pressure oil chamber 48 is connected to the advancing chamber 12 through the oil passage 51*b* as shown in FIG. 1. The valve bodies 26 and 36 move toward the check valves 20 and 30 against the biasing force of the compression coil springs 27 and 37 respectively to abut the valve bodies 21 and 31 due to a pressure difference between the pressure oil chambers 40 and 41 and a pressure difference between the pressure oil chambers 45 and 46, in other words, due to a pressure difference between oil passages 61*a* and 61*b* shown in FIG. 2. The rods 26*a* and 36*a* press the valve bodies 21 and 31 further to leave the seal rings 22 and 32 thereby to open against the biasing force of the compression coil springs 24 and 34.

A journal portion 52 of the cam shaft 2 is carried rotatably by a bearing 53 formed in the cylinder head 7 and the axial movement thereof is regulated. Annular grooves 54*a* and 54*b* are formed on the outer periphery of the journal portion 52. An oil supply passage 57 through which oil is supplied from a oil tank 55 under pressure and an oil discharge passage 58 through which oil is discharged to the oil tank 55 can be connected to the annular grooves 54*a* and 54*b* or disconnected therefrom selectively by a switching valve 59. The switching valve 59 used in this embodiment is a conventional four-port pilot valve.

The annular groove 54*a* is connected to the oil passage 61*a* in the vane rotor 9 through the oil passage 60*a* in the cam shaft 2, and the oil passage 61*a* is connected to the pressure oil chamber 42 of the vane 9*a* through the oil passage 62*a*, and to the pressure oil chamber 45 of the vane 9*b* through the oil passage 63*a*. The annular groove 54*b* is connected to the oil passage 60*b* in the cam shaft 2 and the oil passage 61*b* in the vane rotor 9, and the oil passage 61*b* is connected to the pressure oil chamber 47 of the vane 9*b* through the oil passage 62*b*, and to the pressure oil chamber 40 of the vane 9*a* through the oil passage 63*b*. The oil passages 62*a*, 62*b*, 63*a* and 63*b* are isolated from the gap 16 by balls 71 at portions near the outer peripheries of the vanes 9*a* and 9*b* as shown in FIG. 1. An oil passage 65*a* connecting the retarding chambers 10 and 11 and an oil passage 65*b* connecting the advancing chambers 12 and 13 are formed in the vane rotor 9. Thus, pressure oil from the pump 56 is supplied selectively to the annular grooves 54*a* or 54*b* by the switching valve 59 so that the pressure oil from the pump 56 can be supplied to the retarding chambers 10 and 11 and the advancing chambers 12 and 13 through the check valves 20 and 30 being opened.

Figure 4:
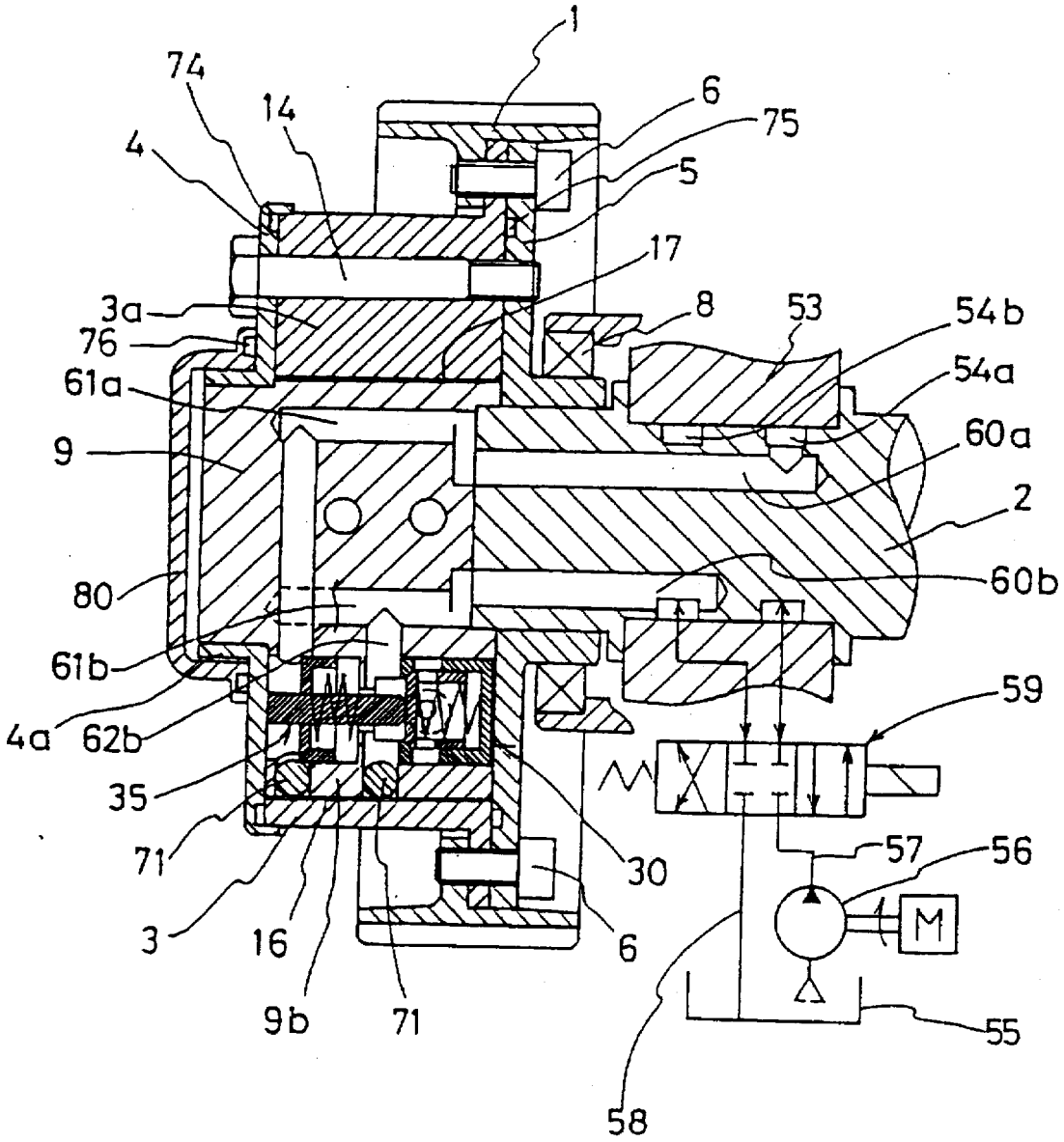
FIG. 4 is a cross-sectional view illustrating a shoe housing being locked.

Since the sealing members 72 are disposed on the sliding outer surfaces of the vanes 9*a* and 9*b* between the vane rotor 9 and the shoe housing 3, connection through the gap 16 between the retarding chamber 10 and the advancing chamber 13 and between the retarding chamber 11 and the advancing chamber 12 are interrupted. Since the sealing members 73 are disposed at the inner surfaces of the shoe 3*a* and 3*b*, connection through the gap 17 between the retarding chamber 10 and the advancing chamber 12 and between the retarding chamber 11 and the advancing chamber 13 are interrupted. Rubber gaskets 74 and 75 are disposed and compressed respectively between the shoe housing 3 and the front plate 4 and between the shoe housing 3 and the rear plate 5 so that the pressure oil may not leak from the retarding chambers 10 and 11 and the advancing chambers 12 and 13 to the outside through radial paths or gaps as shown in FIG. 4. A male screw is formed on an outer periphery of the boss portion 4*a* of the front plate, and a female screw formed in a front cover 80 is screwed to fix the front cover 80 to the front plate 4 via a rubber gasket 76.

Figure 5:
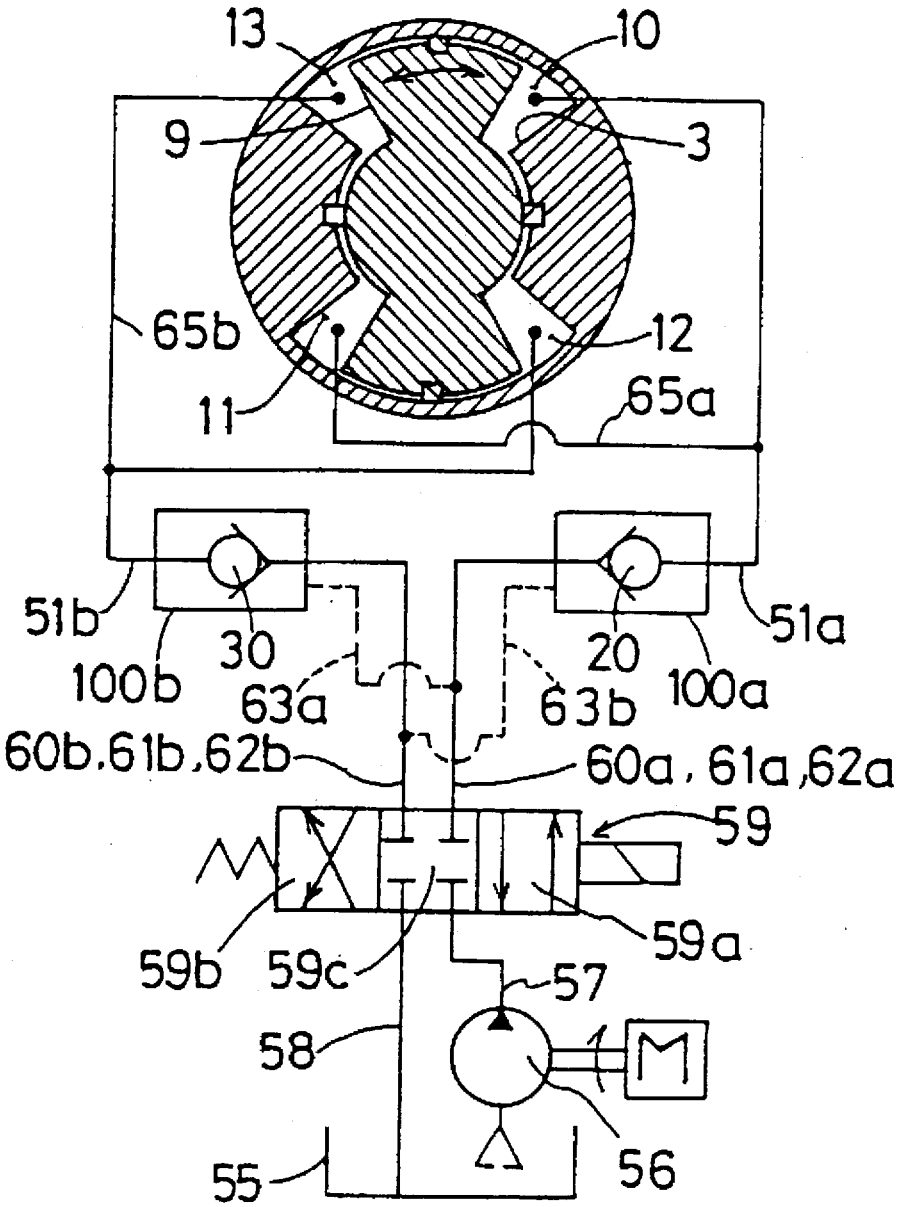
FIG. 5 is a schematic view illustrating a pressure oil circuit according to the first embodiment shown in FIG. 1.

Operation of the valve timing control device is described with reference to FIG. 1, FIG. 2 and FIG. 5.

(1) If a first valve 59*a* of the switching valve 59 is selected, the pressure oil driven from the pump 56 is sent to the pressure oil chamber 42 through the annular groove 54*a*, the oil passages 60*a*, 61*a* and 62*a*. Accordingly, the pressure oil separates the valve body 21 from the seal ring 22 (that is, open) against the compression coil spring 24, passes through pressure oil chamber 43 and oil passage 51*a* and goes into the retarding chamber 10, and, further, goes into the retarding chamber 11 through the oil passage 65*a*. The pressure oil in the retarding chambers 10 and 11 pushes the vanes 9*a* and 9*b* to rotate the vane 9 counter-clockwise (in the retarding direction) relative to the shoes 3*a* and 3*b*. The pressure oil in the oil passage 61*a* goes to the pressure oil chamber 45 through the oil passage 63*a*. On the other hand, the annular groove 54*b* is connected to the oil discharge passage 58 and has atmospheric pressure. The pressure oil chambers 47 and 46, which are connected to the annular groove 54*b* through the oil passages 60*b*, 61*b* and 62*b*, have also atmospheric pressure. Since the pressure in the pressure oil chamber 45 is higher than the pressure in the pressure oil chamber 46, the valve body 36 moves toward the check valve 30 against the compression coil spring 37 and the rod 36*a* pushes the valve body 31 to separate from the seal ring 32 (that is, open) against the compression coil spring 34. As a result, the advancing chambers 12 and 13 are connected to the oil discharge passage 58 through the pressure oil chamber 47 and the oil passages 62*b*, 61*b* and 60*b* so that the oil in the advancing chambers 12 and 13 is discharged to the oil discharge passage 58 when the vane rotor 9 is rotated in the retarding direction.

(2) If a second valve 59*b* of the switching valve 59 is selected, the pressure oil driven from the pump 56 is sent to the pressure oil chamber 47 through the annular groove 54*b*, the oil passages 60*b*, 61*b* and 62*b*. Accordingly, the pressure oil separates the valve body 31 from the seal ring 22 (that is, open) against the compression coil spring 24, passes through pressure oil chamber 48 and oil passage 51*b* and goes into the advancing chamber 12, and, further, goes into the advancing chamber 13 through the oil passage 65*b*. The pressure oil in the advancing chambers 12 and 13 pushes the vanes 9*a* and 9*b* to rotate the vane 9 clockwise (in the advancing direction) relative to the shoes 3*a* and 3*b*. The pressure oil in the oil passage 61*b* goes to the pressure oil chamber 40 through the oil passage 63*b*. On the other hand, the annular groove 54*a* is connected to the oil discharge passage 58 and has atmospheric pressure. The pressure oil chambers 42 and 41, which are connected to the annular groove 54*a* through the oil passages 60*a*, 61*a* and 62*a*, have also atmospheric pressure. Since the pressure in the pressure oil chamber 40 is higher than the pressure in the pressure oil chamber 41, the valve body 26 moves toward the check valve 20 against the compression coil spring 27 and the rod 26*a* pushes the valve body 21 to separate from the seal ring 22 (that is, open) against the compression coil spring 24. As a result, the retarding chambers 10 and 11 are connected to the oil discharge passage 58 through the pressure oil chamber 42 and the oil passages 62*a*, 61*a* and 60*a* so that the oil in the retarding chambers 10 and 11 is discharged to the oil discharge passage 58 when the vane rotor 9 is rotated in the advancing direction.

(3) If a third valve 59*c* of the switching valve 59 is selected, the oil in the retarding chambers 10 and 11 and in the advancing chambers 12 and 13 is confined, thereby maintaining the difference between the phase of timing pulley and the phase of the vane rotor 9 and the cam shaft 2 unchanged.

Operation of the valve timing control device in response to torque change of the cam shaft 2 is further described.

Figure 6:
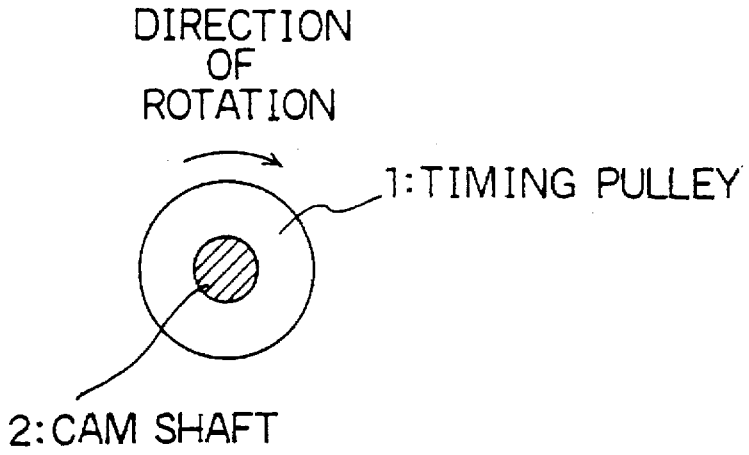
FIG. 6 is a schematic view illustrating a direction of rotation of a cam shaft and a timing pulley according to the first embodiment.

The cam shaft 2 rotates clockwise to drive the intake and exhaust valves (not shown) while developing torque relative to the timing pulley as shown in FIG. 6.

Figure 7:
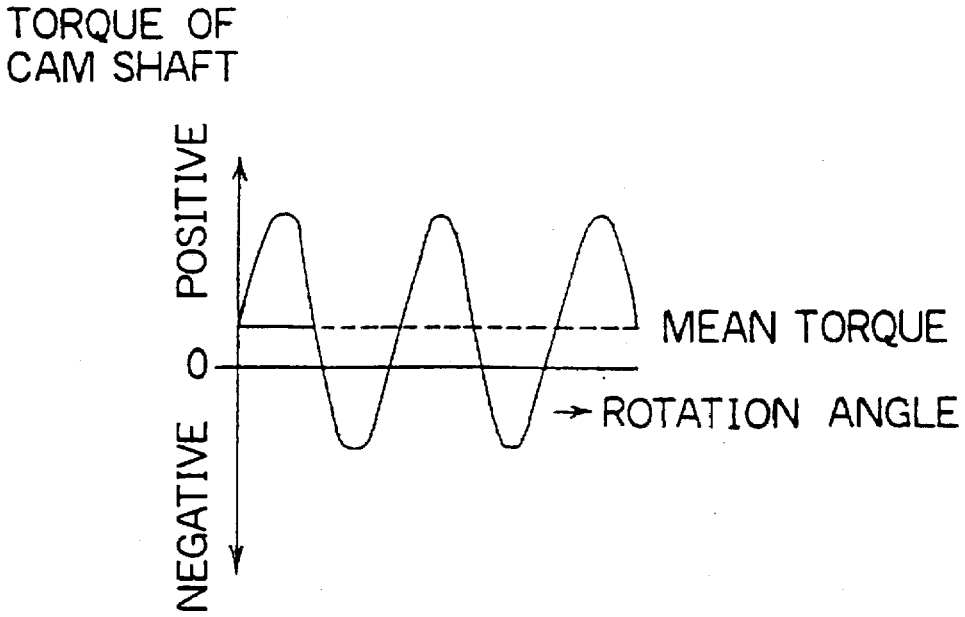
FIG. 7 is a graph showing change in torque of the cam shaft according to the first embodiment.

(1) When the second valve 59*b* of the switching valve 59 is selected so that the pressure oil in the advancing chambers 12 and 13 pushes the vanes 9*a* and 9*b* to rotate the vane rotor 9 clockwise relative to the shoes 3*a* and 3*b*, positive torque is generated as shown in FIG. 7 and oil pressure corresponding to the positive torque is generated in the advancing chambers 12 and 13. When the pressure of the oil driven from the pump 56 is greater than the oil pressure in the advancing chambers 12 and 13 (that is, when the positive torque is small or the torque is negative), the pressure of the oil driven from the pump 56 is applied to rotate the vane 9 clockwise relative to the shoe housing 3. Since the retarding chambers 10 and 11 are connected to the oil discharge passage 58 to discharge the oil in the chambers 10 and 11 to the tank 55, the vane rotor 9 rotates clockwise relative to the shoe housing 3. In other words, the cam shaft 2 rotates in the advancing direction relative to the timing pulley 1. When the oil pressure in the advancing chambers 12 and 13 is greater than the pressure of oil driven from the pump 56 (that is, positive torque is large), the oil pressure in the pressure oil chamber 49 becomes greater than the oil pressure in the pressure oil chamber 47. The difference between the pressure oil chambers 47 and 49 closes the check valve 30 to prevent the oil in the advancing chambers 12 and 13 from returning to the pump 56, thereby preventing the oil pressure in the advancing chambers 12 and 13 from decreasing. As a result, the vane rotor 9 is prevented from rotating counter-clockwise relative to the shoe housing 3 and stops. Thus, the cam shaft 2 rotates intermittently only clockwise relative to the timing pulley 1 to advance the operation timing of the intake and exhaust valves and will not rotate counter-clockwise.

(2) When the first valve 59*a* of the switching valve 59 is selected to push the vanes 9*a* and 9*b* and rotate the vane rotor 9 counter-clockwise relative to the shoe housing 3, negative torque is generated as shown in FIG. 7. If the negative torque is small or the torque is positive, the vane rotor 9 rotates counter-clockwise relative to the shoe housing 3. If the negative torque is large, the vane rotor 9 stops in the same ways mentioned above. Thus, the cam shaft 2 rotates intermittently only counter-clockwise relative to the timing pulley 1 to retard the operation timing of the intake and exhaust valves.

(3) When the third valve 59*c* of the switching valve 59 is selected, connection of the retarding chambers 10 and 11 and advancing chambers 12 and 13 with the oil supply passage 57 or the oil discharge passage 58 is severed, thereby confining the oil in the retarding chambers 10 and 11 and the advancing chambers 12 and 13 to stop the vane rotor 9 at any place. If the pilot type check valves 100*a* and 100*b* are not disposed, positive and negative oil pressures are generated intermittently in the retarding chambers 10 and 11 and the advancing chambers 12 and 13. As a result, the oil may leak from the chambers and air may get therein through gaps between the cam journal portion 52 and the bearing 53 to gradually increase vibration of the vane rotor According to the first embodiment, (1) the shortest distance $L_1$ between end surfaces of the vanes 9*a* and 9*b* which seal portions between the retarding chamber 10 and the advancing chamber 13 and between the retarding chamber 11 and the advancing chamber 12 is formed to be equal to the shortest distance $L_2$ between end surfaces of the shoes 3*a* and 3*b* which seal portions between the retarding chamber 10 and the advancing chamber 12 and between the retarding chamber 11 and the advancing chamber 13; (2) since the cross sections of the fan-shaped portion of the vanes 9*a* and 9*b* are approximately equal to the trapezoidal cross sections of the shoes 3*a* and 3*b*, the oil leakage between the retarding chamber 10 and the advancing chamber 13 and between the retarding chamber 11 and the advancing chamber 12 through small gaps formed between the vane rotor 9 and the front plate 4 and the rear plate 5 (if any) can be reduced. Thus, a desired difference of oil pressure between the retarding chamber 10 and the advancing chamber 12, and between the retarding chamber 11 and the advancing chamber 13 can be provided timely so that the operation of the intake and exhaust valves can be controlled accurately.

According to the first embodiment, the pilot type check valves 100*a* and 100*b* are disposed inside the vanes 9*a* and 9*b* of the vane rotor 9 so that portions subject to oil leakage can be reduced. In addition, since the valve bodies 21, 26, 31 and 36, (which are driven by the pressure oil) are disposed in the vanes 9*a* and 9*b* to move in the same direction as the axis of the cam shaft 2, the centrifugal force caused during rotation of the vane rotor 9 does not affect such direction so that operation accuracy of the intake and the exhaust valves controlled by the pilot type check valves 100*a* and 100*b* can be enhanced.

(Second Embodiment)

A second embodiment of the present invention is described with reference to FIG. 8 and FIG. 9. The same reference numerals are put to the same parts or portions as those of the first embodiment.

In the first embodiment, the retarding chambers 10 and 11 are connected through the oil passage 65*a* and the advancing chambers are connected through the oil passage 65*b*. On the other hand, in the second embodiment, the retarding chamber 11 is connected to the oil passage 62*a* through an oil passage 90*a*, and the advancing chamber 13 is connected to the oil passage 62*b* through an oil passage 90*b*. Accordingly, the retarding chamber 10 is connected to the oil passage 61*a* through the check valve 20, and the retarding chamber 11 is connected to the oil passage 61*a* directly, On the other hand, the advancing chamber 12 is connected to the oil passage 61*b* through the check valve 30, and the advancing chamber 13 is connected to the oil passage 61*b* directly.

Thus, since the oil is supplied to the retarding chamber 10 and advancing chamber 12 through the check valves 20 and 30, the vibration of the vane rotor 9 caused by the positive and negative torque can be prevented. In addition, since the retarding chamber 11 and the advancing chamber 13 are connected directly to the respective oil passages 61*a* and 61*b*, pressure loss caused when the oil is supplied or discharged can be reduced so that the intake and the exhaust valves can be controlled without delay.

Figure 8:
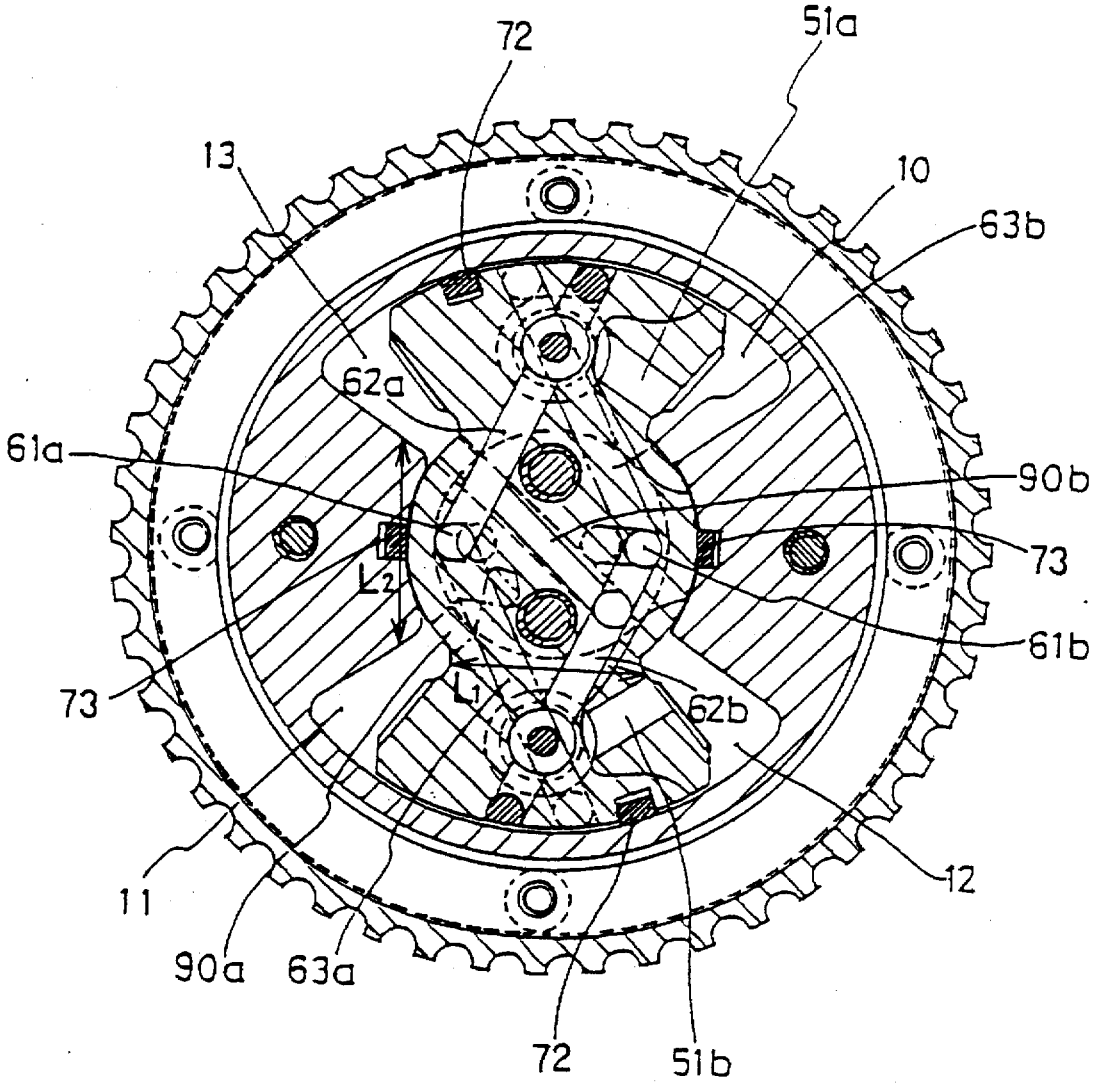
FIG. 8 is a cross-sectional view illustrating a valve timing control device according to a second embodiment.
Figure 9:
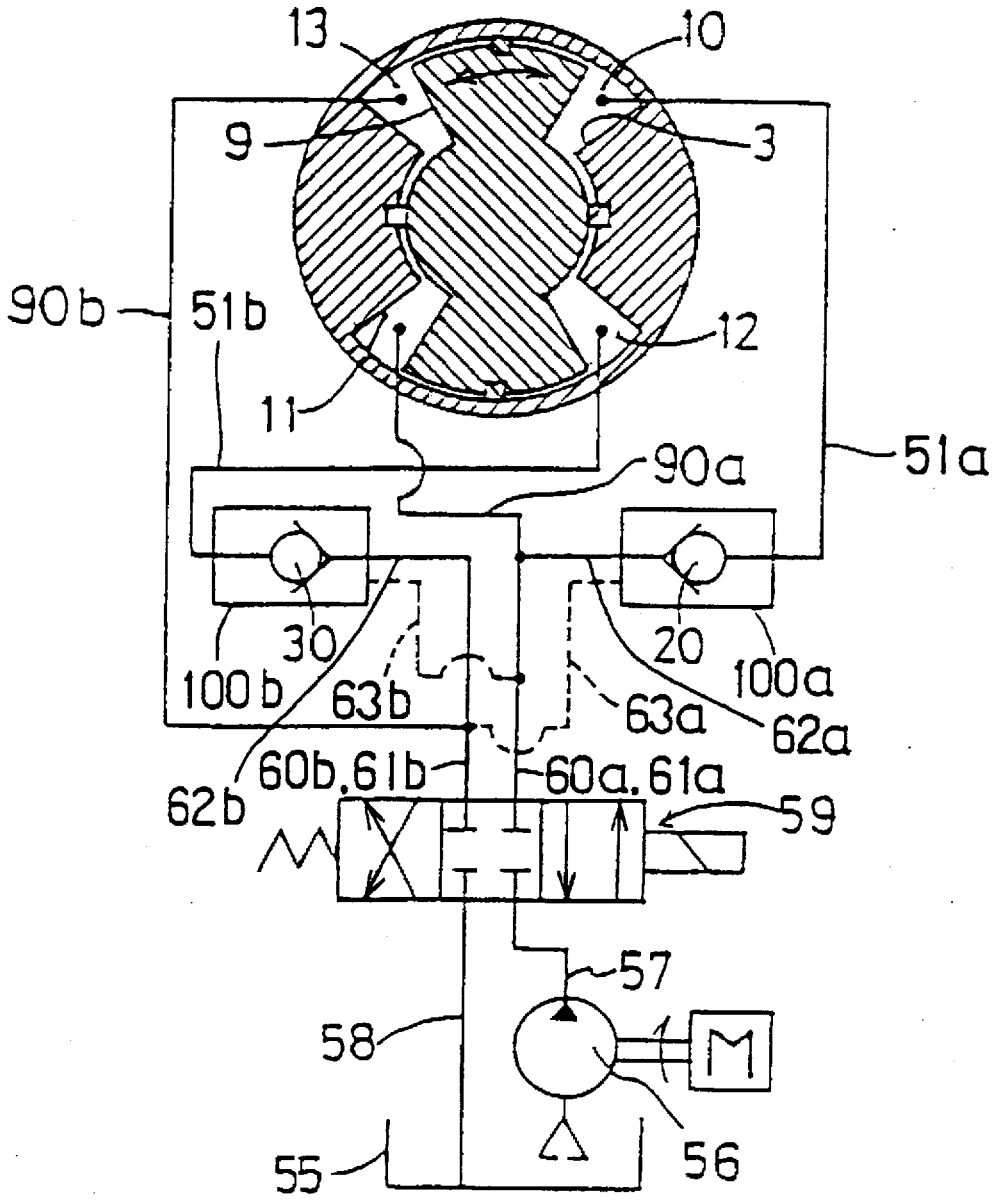
FIG. 9 is a schematic view illustrating a oil pressure circuit according to the second embodiment.

The shortest distance $L_1$ between end surfaces of the vanes 9*a* and 9*b* which seal portions between the retarding chamber 10 and the advancing chamber 13 and between the retarding chamber 11 and the advancing chamber 12 is formed to be equal to the shortest distance $L_2$ between end surfaces of the shoes 3*a* and 3*b* which seal portions between the retarding chamber 10 and the advancing chamber 12 and between the retarding chamber 11 and the advancing chamber 13, as shown in FIG. 8. The cross sections of the fan-shaped portion of the vanes 9*a* and 9*b* are approximately equal to the trapezoidal cross sections of the shoes 3*a* and 3*b*. Thus, the oil leakage between the retarding chamber 10 and the advancing chamber 13 and between the retarding chamber 11 and the advancing chamber 12 can be reduced so that pressures in the respective pressure oil chambers can be controlled without delay.

(Third Embodiment)

A third embodiment of the present invention is described with reference to FIG. 10, FIG. 11 and FIG. 12. The same reference numerals are put to the same parts or portions as those of the first embodiment.

A cam shaft 102 is driven by the timing pulley 1, which is a rotation transmitting member, to rotate at a certain angular phase difference from the timing pulley 1. The timing pulley 1 and the cam shaft 102 rotate clockwise in the direction indicated by an arrow in FIG. 10, which is the advancing direction.

The shoe housing 103 and the front plate 4 are fastened in a unit coaxially with the timing pulley 1 by the bolts 14. The timing pulley 1 and the rear plate 5 are fastened coaxially by the four bolts 6. The inner surface of the boss portion 5*a* of the rear plate 5 rotatably receives the head portion 102*a* of the cam shaft 102, and the outer periphery of the boss portion 5*a* is in contact with the oil seal 8 of the cylinder head 7.

Figure 10:
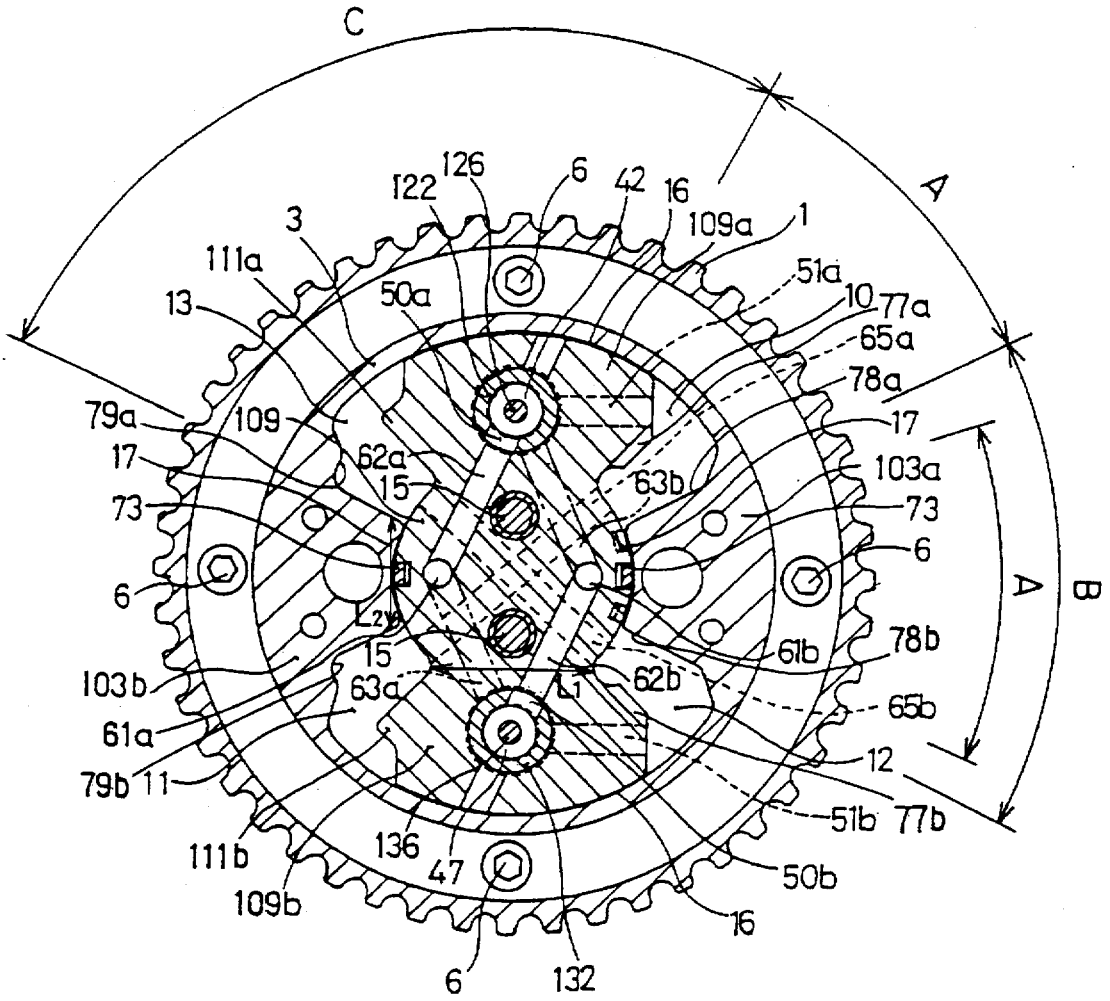
FIG. 10 is a cross-sectional view cut along a line X—X of FIG. 11 illustrating a valve timing control device for an engine according to a third embodiment.

The shoe housing 103 has a pair of trapezoidal shoes 103*a* and 103*b* facing each other as shown in FIG. 10. Each surface of the shoes 103*a* and 103*b* facing each other is formed into an arc shape, and each circumferential space between the shoes 103*a* and 103*b* is formed into a fan shape.

A vane rotor 109 has a pair of fan-shaped vanes 109*a* and 109*b* at opposite sides thereof, which are rotatably disposed in the circumferential fan-shaped spaces formed between the shoes 103*a* and 103*b* respectively. A concave portion 109*c* receives a head portion 102*a* of the cam shaft 102 coaxially, and the vane rotor 109 is fastened to the cam shaft 102 by two bolts 15. A cylindrical head 109*d* formed integrally with the vane rotor 109 is fitted rotatably to the boss portion 4*a* of the front plate 4. Small gaps 16 and 17 are formed between the outer periphery of the vane rotor 109 and the inner periphery of the shoe housing 103 as shown in FIG. 10, and the vane rotor 109 can rotate relative to the shoe housing 103. The retarding chambers 10 and 11 or the advancing chambers 12 and 13 are formed between the shoe 103*a* and vane 109*a*, between the shoe 103*b* and the vane 109*b*, between the shoe 103*a* and the vane 109*b* and between the shoe 103*b* and the vane 109*a* respectively. Small gaps or clearances are formed between one end surface of the vane rotor 109 and the front plate 4 and the other end surface of the vane rotor 109 and the rear plate 5 so that the vane rotor can rotate relative to the shoe housing 103. Accordingly, the axial size of the vanes 109*a* and 109*b* is shorter than that of the shoe housing disposed between the front plate 4 and the rear plate 5. Thus, the cam shaft 102 and the vane rotor 109 rotate coaxially relative to the timing pulley 1, the shoe housing 103, the front plate 4 and the rear plate 5.

Stoppers 77*a* and 77*b* are formed respectively on a side of the vane 109*a* facing the retarding chamber 10 and on a side of the vane 109*b* facing the advancing chamber 12, and stoppers 78*a* and 78*b* are formed respectively on both sides of the shoe 103*a* facing the retarding chamber 10 and advancing chamber 22.

(1) When the vane rotor rotates in the advancing direction, the stopper 77*b* abuts the stopper 78*b* so that vane rotor 109 is stopped from rotating in the advancing direction. When the vane rotor 109 rotates in the advancing direction and the stopper 77*b* approaches the stopper 78*b*, a projection 111*a* (which is formed on a side of the vane 109*a* facing the advancing chamber 13) is going to rotate in the advancing direction at a distance from a side 79*a* of the shoe 103*b* facing the advancing chamber 13 to form a small space. As a result, the oil in the small space dumps shocks caused when the stopper 77*b* abuts the stopper 78*b*.

(2) When the rotor 109 rotates in the retarding direction, the stopper 77*a* abuts the stopper 78*a* so that the vane rotor is stopped from rotating in the retarding direction. When the vane rotor 109 rotates in the retarding direction and the stopper 77*a* approaches the stopper 78*a*, a projection 111*b* (which is formed on a side of the vane 109*b* facing the retarding chamber 11) is going to rotate in the retarding direction at a distance from a side 79*b* of the shoe 103*b* facing the retarding chamber 13 to form a small space. As a result, the oil in the small space dumps shocks caused when the stopper 77*a* abuts the stopper 78*a*.

(1) The shortest distance $L_1$ between end surfaces of the vanes 109*a* and 109*b* which seal portions between the retarding chamber 10 and the advancing chamber 13 and between the retarding chamber 11 and the advancing chamber 12 is formed to be longer than the shortest distance $L_2$ between end surfaces of the shoes 103*a* and 103*b* which seal portions between the retarding chamber 10 and the advancing chamber 12 and between the retarding chamber 11 and the advancing chamber 13 as shown in FIG. 10. (2) The cross sections of the fan-shaped portion of the vanes 109*a* and 109*b* are formed to be greater than the trapezoidal cross sections of the shoes 103*a* and 103*b*. (3) In FIG. 10, a rotation angle A° is an angle between a position where the stopper 77*a* abuts the stopper 78*a* and a position where the stopper 77*b* abuts the stopper 78*b*. Since the sealing members 73 are fixed to portions of the vane rotor 109, an angle B°, which is formed between both sides of the shoe 103*a* and 103*b* to be suitable for the sealing member 73 to seal the gap between the outer periphery of the vane rotor 109 and the inner periphery of the shoe housing 103, is given as follows: B°=A°+(an angle formed between both sides of the sealing member 73). The angle B° has a margin for compensating wear of the sealing member and, therefore, B°≈A°. If the fan-shaped vanes 109*a* and 109*b* are formed to have the fan-shaped space of an angle C°=180°−(A°+B°)≈180°−2A°, sealing for the gap formed between the outer periphery of the vane rotor 109 and the inner periphery of the shoe housing, particularly the sealing for the gap 16 becomes long. Accordingly, the oil leakage between the retarding chamber 10 and the advancing chamber 13 and between the retarding chamber 11 and the advancing chamber 12 along the outer periphery of the vane rotor 109 can be reduced without having the sealing members 72 which are used for the first and second embodiments. Clearances formed between one end surface of the vane rotor 109 and the front plate 4 and the other end surface of the vane rotor 109 and the rear plate 5 can be sealed surely by both end surfaces of the vanes 109*a* and 109*b*. Thus, the oil leakage between the pressure oil chambers can be reduced and highly responsive and accurate control of the intake and exhaust valves can be carried out.

Figure 11:
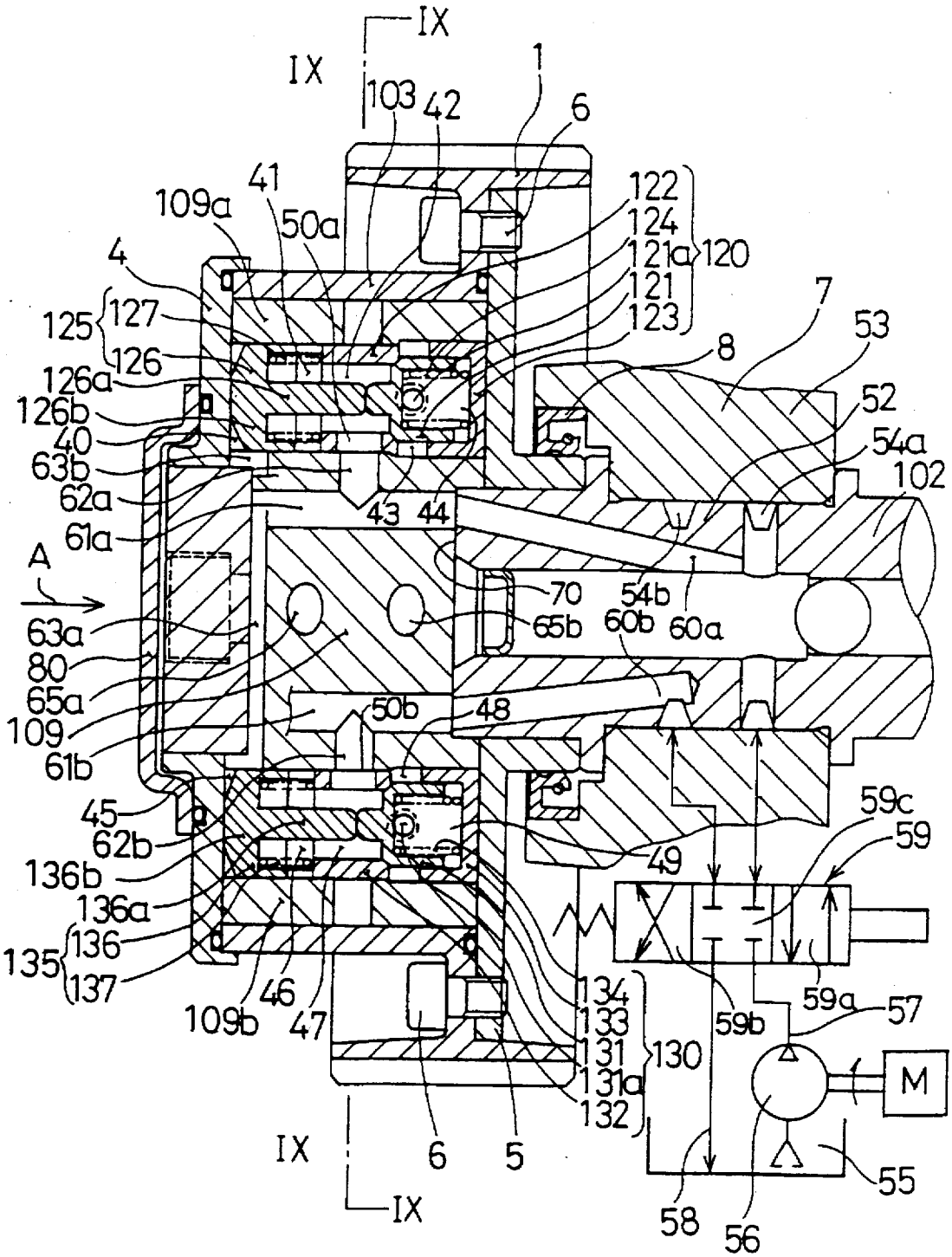
FIG. 11 is a cross-sectional view illustrating the valve timing control device for an engine according to the third embodiment.
Figure 12:
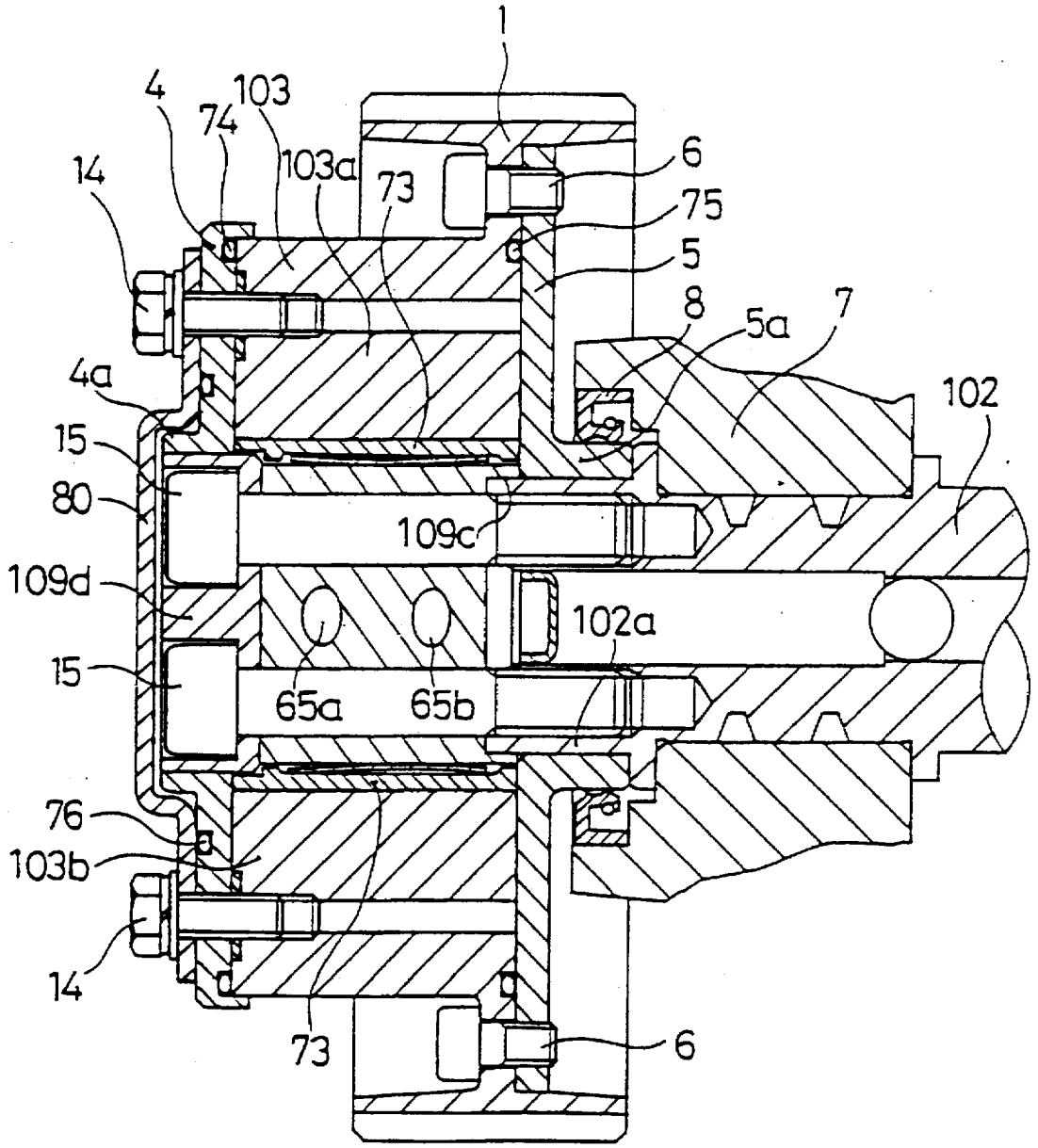
FIG. 12 is a cross-sectional view to illustrate the valve timing control device for an engine according to the third embodiment.

Check valves 120 and 130 are disposed inside the vanes 109*a* and 109*b* of the vane rotor 109 as shown in FIG. 11. The check valve 120 is composed of a valve body 121, a valve seat 122, a guide member 123 and a compression coil spring 124, and the check valve 130 is composed of a valve body 131, a valve seat 132, a guide member 133 and a compression coil spring 134. The valve bodies 121 and 131 are formed into cylindrical members having bottoms and oil holes 121*a* and 131*a* respectively. The valve bodies 121 and 131 are biased by the compression coil springs 124 and 134 so that the bottoms are seated on seat members formed respectively on the valve seats 122 and 132 to close as shown in FIG. 11. The guide members 123 and 133 are formed into cylindrical members which have bottoms, and have openings open in a direction opposite the openings of the valve bodies 121 and 131. The valve bodies 121 and 131 are received by the inner surfaces of the guide members 123 and 133 to slide in the axial direction of the cam shaft 102. Oil passages 50*a* and 50*b* are formed in the valve seats 122 and 132.

Pilot valves 125 and 135 are disposed to face the check valves 120 and 130. The pilot valve 125 is composed of a valve body 126 and a compression coil spring 127, and the pilot valve 135 is composed of a valve body 136 and a compression coil spring 27. The valve bodies 126 and 136 are disposed inside the vanes 109*a* and 109*b* so as to move back and forth in the axial direction of the camshaft 2. The valve bodies 126 and 136 are biased against the inner surface of the front plate 4 by the compression coil spring 127 and 137 respectively. The valve body 126 is molded to have a rod 126*a* and a sliding member 126*b* in a unit, and the valve body 136 is molded to have a rod 136*a* and a sliding member 136*b* in a unit. The rods 126*a* and 136*a* extend through the valve seats 122 and 132 to portions near the valve bodies 121 and 131. The sliding members 126*b* and 136*b* are composed of disk portions for retaining the coil springs 127 and 137 and annular sliding members extending axially from the periphery of the disk portions. The check valve 120 and the pilot valve 125 form a pilot type check valve 100*a* which is shown in FIG. 5 for the first embodiment, and the check valve 130 and the pilot valve 135 form a pilot type check valve 100*b* which is shown in FIG. 5 for the first embodiment.

Pressure oil chambers 40 and 41 are formed on both ends of the valve body 126, and pressure oil chambers 45 and 46 are formed on both ends of the valve body 136. Pressure oil chambers 42, 43 and 44 are formed on both ends of the valve body 121, and pressure oil chambers 47, 48 and 49 are formed on both ends of the valve body 131. The pressure oil chambers 41 and 42 are connected through the valve seat 122; the pressure oil chambers 46 and 47 are connected through the valve seat 132; the pressure oil chambers 43 and 44 are connected by the oil hole 121*a* formed in the valve body 121; and the pressure oil chambers 48 and 49 are connected by the oil hole 131*a* formed in the valve body 131. Connection of the pressure oil chambers 42 and 44 is interrupted when the valve body 121 is seated on the seal ring 122, and is established when the valve body 121 leaves the valve seat 122. Connection of the pressure oil chambers 47 and 49 is interrupted when the valve body 131 is seated on the valve seat 132, and is established when the valve body 131 leaves the valve seat 132. The pressure oil chamber 42 is connected to the oil passage 61*a* through the oil passage 50*a* and 62*a*, and the pressure oil chamber 47 is connected to the oil passage 61*b* through the oil passage 50*b* and the oil passage 62*b*. The pressure oil chamber 40 is connected to the oil passage 61*b* through the oil passage 63*b*, and the pressure oil chamber 45 is connected to the oil passage 61*a* through the oil passage 63*a*. The pressure oil chamber 43 is connected to the retarding cheer 10 through the oil passage 51*a* which is shown in FIG. 11, and the pressure oil chamber 48 is connected to the advancing chamber 12 through the oil passage 51*b* as shown in FIG. 11. The valve bodies 126 and 136 move toward the check valves 120 and 130 against the biasing force of the compression coil springs 127 and 137 respectively to abut the valve bodies 121 and 131 due to a pressure difference between the pressure oil chambers 40 and 41 and a pressure difference between the pressure oil chambers 45 and 46, in other words, due to a pressure difference between oil passages 61*a* and 61*b* as shown in FIG. 11. The rods 126*a* and 136*a* press the valve bodies 121 and 131 further to leave the valve seats 122 and 132 thereby to open the check valves 120 and 130 against the biasing force of the compression coil springs 124 and 134.

The oil passage 60*a*, which is a first oil passage in the cam shaft 102, is connected to the annular groove 54*a* and to the oil passage 61*a* in the vane rotor 109 at a portion 70 where the cam shaft 102 and the vane rotor 109 are in contact with each other. The oil passage 61*a* is connected to the pressure oil chamber 42 in the vane 109*a* through the oil passage 62*a*, and to the pressure oil chamber 45 in the vane 109*b* through the oil passage 63*a*. The oil passage 60*b*, which is a second oil passage in the cam shaft 102, is connected to the annular groove 54*b* in the cam shaft 2 and to the oil passage 61*b* in the vane rotor 109 at the portion 70, and the oil passage 61*b* is connected to the pressure oil chamber 47 of the vane 109*b* through the oil passage 62*b*, and to the pressure oil chamber 40 of the vane 109*a* through the oil passage 63*b*. The oil passages 62*a* and 62*b* are isolated from the gap 16 by the valve seats 122 and 132 as shown in FIG. 11. An oil passage 65*a* connecting the retarding chambers 10 and 11 and an oil passage 65*b* connecting the advancing chambers 12 and 13 are formed in the vane rotor 109. Thus, pressure oil from the pump 56 is supplied selectively to the annular grooves 54*a* and 54*b* by the switching valve 59 so that the pressure oil from the pump 56 can be supplied to the retarding chambers 10 and 11 or the advancing chambers 12 and 13 through the check valves 120 and 130 being opened.

In the third embodiment, since the vanes 109*a* and 109*b* are formed to cover an angle C° of the fan-shaped space, the pilot type check valves 100*a* and 100*b* of the first embodiment can be accommodated respectively inside the vanes 109*a* and 109*b* without difficulty.

(Fourth Embodiment)

A fourth embodiment of the present invention is described with reference to FIG. 13. The same reference numerals are put to the parts or portions which are the same as those of the third embodiment.

Figure 13:
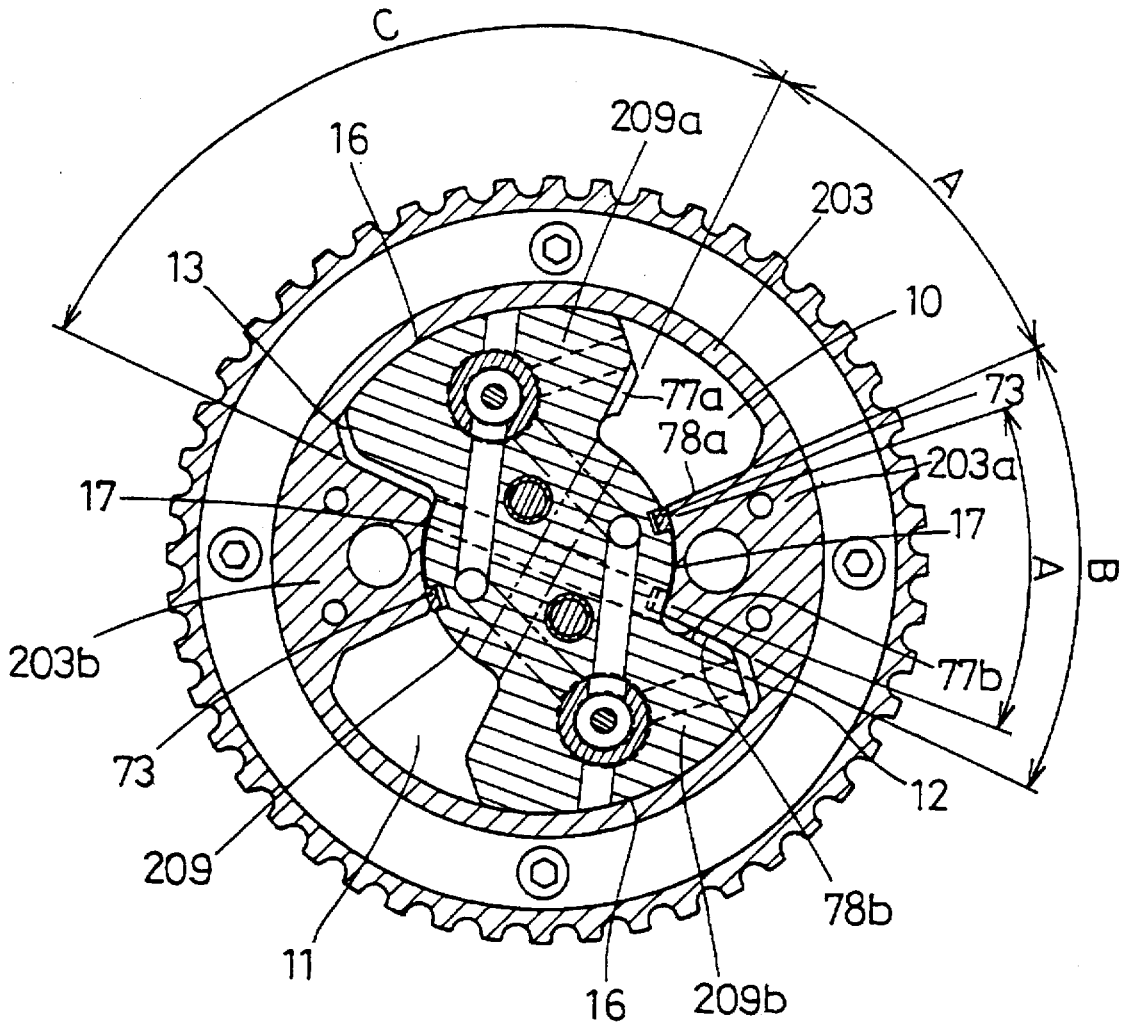
FIG. 13 is a cross-sectional view illustrating a valve timing control device for an engine according to a fourth embodiment.

There is no projection such as the projection 111*a* or 111*b* of the third embodiment on vanes 209*a* or 209*b* of a vane rotor 209, which has an almost symmetric cross-section with regard to a diametral line as shown in FIG. 13. Shoes 203*a* and 203*b* of a shoe housing 203 have also symmetric cross sections with regard to a diametral line as shown in FIG. 13.

The fan-shaped vanes 209*a* and 209*b* according to the fourth embodiment are also formed to cover the fan-shaped space extending between an angle $C°=180°-(A°+B°)\approx 180°-2A°$ as in the third embodiment. Thus, the oil leakage between the respective pressure oil chambers is reduced so that highly responsive and accurate operation of the intake valve and the exhaust valve can be ensured.

The check valves and the pilot valves which compose the pilot type check valves are accommodated inside both vanes to control the retarding chambers 10 and 11 and the advancing chambers 12 and 13 in the preceding embodiments of the present invention. However, only one pilot type check valve can be accommodated inside either one of the vanes to control angular phase difference of the camshaft from the timing pulley. The pilot type check valve can be disposed inside the cam shaft instead of the vane.

The pilot type check valve is used as a moving member and disposed inside the vane to move along the axis of the vane in the previous embodiments. However, a moving member such as a spool can be disposed inside the vane to move in the axial direction of the vane instead of the pilot type check valve.

The pilot type check valves 100*a* and 100*b* in the previous embodiments of the present invention are opened by the pressure difference between the first oil passage and the second oil passage against the oil pressure of the retarding chambers 10 and 11 and the advancing chambers 12 and 13. However, the second pilot type check valve can be opened only by the oil pressure in the first oil passage, and the first pilot type check valve can be opened only by the oil pressure of the second oil passage.

Two shoes are formed in the shoe housing and two vanes are formed on the vane rotor to form two retarding chambers 10 and 11 and two advancing chambers 12 and 13 in the previous embodiments of the present invention. However, the number of the retarding chambers or the advancing chambers is not limited to two.

INDUSTRIAL APPLICABILITY

As described above, the vane-type angular-phase-adjusting device according to the present invention, particularly, the valve timing control device for an internal combustion engine using the vane-type angular-phase-adjusting device can reduce influence of the centrifugal force exerted on the members moving in response to the oil pressure. Since the moving members are disposed inside the vanes, width of the vanes can be increased to ensure sealing of the gaps between the retarding chambers and the advancing chambers, and a device having small outer diameter can be provided.

We claim:

1. A vane-type angular-phase-adjusting device having an input shaft and an output shaft comprising:

a shoe housing having a circular space, and a fan-shaped space disposed radially outside said circular space formed inside said shoe housing and connected to one of said input and output shafts;

a vane rotor having a vane at an outer periphery and a rotating shaft, said vane projecting radially from said outer periphery and is disposed rotatably in said fan-shaped space to partition said space into an advancing chamber and a retarding chamber; and a moving member, disposed inside said vane of said vane rotor, moving in response to oil pressure, said moving member comprising a member moving in a direction substantially in parallel with axes of said rotating shafts of said shoe housing and said vane rotor.

2. A vane-type angular-phase-adjusting device as claimed in claim 1, wherein said vane rotor further includes vanes totalling to n-vanes each having an arc-angle C and a rotation angle A, with a first condition: $C \geqq (360°/n)-2A$;

each of said vanes has a cross-sectional minimum sealing length $L_1$ between said advancing chamber and said retarding chamber and each of said shoe housing has a cross-sectional minimum sealing length $L_2$ between said advancing chamber and said retarding chamber, with a second condition: $L_1$ is equal to or longer than $L_2$;

each of said vanes has cross section sealing a portion between said advancing chamber and said retarding chamber, and said shoe housing has cross section sealing a portion between said advancing chamber and said retarding chamber, with a third condition: said former cross section is equal to or greater than said latter cross section; and wherein said vane-type angular-phase adjusting device has at least one of said three conditions.

3. A vane-type angular-phase-adjusting device as claimed in claim 1 further comprising a plate member, fixed to said shoe housing, for closing open ends of said advancing chamber and said retarding chamber, wherein said moving member is disposed inside said vane to face said plate member.

4. A vane-type angular-phase-adjusting device as claimed in claim 1, wherein said vane rotor has a oil passage connecting one of said advancing chamber and said retarding chamber, and said moving member moves in response to oil pressure of said oil passage.

5. A vane-type angular-phase-adjusting device as claimed in claim 1, wherein said vane rotor comprises a bolt, disposed at a central portion of said vane rotor, for fastening said vane rotor to one of said input shaft or said output shaft.

6. A vane-type angular-phase-adjusting device as claimed in claim 1, wherein said moving member comprises a check valve.

7. A vane-type angular-phase-adjusting device as claimed in claim 1, wherein said moving member comprises a pilot valve.

8. A vane-type angular-phase-adjusting device having an input shaft and an output shaft comprising:

a shoe housing having a circular space, and a fan-shaped space disposed radially outside said circular space formed inside said shoe housing and connected to one of said input and output shafts;

a vane rotor having a vane at an outer periphery, said vane projecting radially from said outer periphery and is disposed rotatably in said fan-shaped space to partition said space into an advancing chamber and a retarding chamber; and a moving member, disposed inside said vane of said vane rotor, moving in parallel with an axis of said vane rotor.

9. A vane-type angular-phase-adjusting device as claimed in claim 8 further comprising a plate member, fixed to said shoe housing, for closing open ends of said advancing chamber and said retarding chamber, wherein said moving member is disposed inside said vane to face said plate member.

10. A vane-type angular-phase-adjusting device as claimed in claim 8, wherein said vane rotor has a oil passage connecting one of said advancing chamber and said retarding chamber, and said moving member moves in response to oil pressure of said oil passage.

11. A vane-type angular-phase-adjusting device as claimed in claim 8, wherein said vane rotor comprises a bolt, disposed at a central portion of said vane rotor, for fastening said vane rotor to one of said input shaft or said output shaft.

12. A vane-type angular-phase-adjusting device as claimed in claim 8, wherein said moving member comprises a check valve.

13. A vane-type angular-phase-adjusting device as claimed in claim 8, wherein said moving member comprises a pilot valve.

14. A vane-type angular-phase-adjusting device as claimed in claim 8, wherein said vane rotor further includes vanes totalling to n-vanes each having an arc-angle C and a rotation angle A, with a first condition: $C \geqq (360°/n)-2A$;

each of said vanes has a cross-sectional minimum sealing length $L_2$ between said advancing chamber and said retarding chamber and each of said shoe housing has a cross-sectional minimum sealing length $L_2$ between said advancing chamber and said retarding chamber, with a second condition: $L_1$ is equal to or longer than $L_2$;

each of said vanes has cross section sealing a portion between said advancing chamber and said retarding chamber, and said shoe housing has cross section sealing a portion between said advancing chamber and said retarding chamber, with a third condition: said former cross section is equal to or greater than said latter cross section; and wherein said vane-type angular-phase adjusting device has at least one of said three conditions.

15. A valve timing control device disposed between a crank shaft and a cam shaft for controlling angular phase between said shafts comprising:

a vane rotor connected to said cam shaft and having at least two vanes protecting radially therefrom;

a shoe housing rotating in synchronism with said crank shaft and rotatably accommodating said vane rotor, said shoe housing having a shoe projecting into a circumferential space between said vanes and defines an advancing chamber and a retarding chamber; and a moving member, disposed inside said vane of said vane rotor, moving in parallel with an axis of said vane rotor and said shoe housing in response to oil pressure.

16. A valve timing control device as claimed in claim 15, wherein said vane rotor has an oil passage connected to said advancing chamber and an oil passage connected to said retarding chamber, and said oil passages open to an axial end of said vane rotor.

17. A valve timing control device as claimed in claim 16, wherein said moving member moves in response to oil pressure of at least one of said advancing chamber and said retarding chamber.

18. A valve timing control device as claimed in claim 15 further comprising a plate member, fixed to said shoe housing, for closing open ends of said advancing chamber and said retarding chamber, wherein said moving member is disposed inside said vane to face said plate member.

19. A valve timing control device as claimed in claim 15, wherein said vane rotor receives a bolt, disposed at a central portion of said vane rotor, for fastening said vane to said cam shaft, and said shoe receives a bolt for fastening a member fixed to said shoe housing.

* * * * *